US005416991A

United States Patent [19]

Jensen

[11] Patent Number: 5,416,991

[45] Date of Patent: May 23, 1995

[54] APPARATUS FOR FEEDING FLATWORK ARTICLES TO A LAUNDRY PROCESSING UNIT

[75] Inventor: Jorn M. Jensen, Bern, Switzerland

[73] Assignee: Ejnar Jensen & Son A/S, Ronne, Denmark

[21] Appl. No.: 8,781

[22] Filed: Jan. 27, 1993

[30] Foreign Application Priority Data

Jan. 19, 1992 [DK] Denmark ..... 106/92

[51] Int. Cl.[6] ..... D06F 69/02

[52] U.S. Cl. ..... 38/143

[58] Field of Search ..... 38/1 R, 1 A, 8, 11, 38/12, 143, 144; 414/13; 198/570, 578, 598; 271/1, 8.1, 34, 264, 267

[56] References Cited

U.S. PATENT DOCUMENTS

| | | | |
|---|---|---|---|
| 3,468,532 | 9/1969 | Valentine | 38/143 X |
| 3,552,743 | 1/1971 | Baboz | 38/12 X |
| 3,664,046 | 5/1972 | Thompson | 38/143 |
| 3,729,846 | 5/1973 | Weir | 38/143 |
| 3,911,604 | 10/1975 | Sjostrom | 38/143 |
| 4,378,645 | 4/1983 | Allen et al. | 38/8 |
| 4,885,853 | 4/1983 | McCabe | 38/143 |
| 5,079,867 | 1/1992 | Kober et al. | 38/8 X |

FOREIGN PATENT DOCUMENTS

| | | | |
|---|---|---|---|
| 0668556 | 9/1964 | Belgium | 38/143 |
| 3608164 | 9/1987 | Germany | 38/143 |

*Primary Examiner*—Clifford D. Crowder
*Assistant Examiner*—Ismael Izaguirre
*Attorney, Agent, or Firm*—Kerkam, Stowell, Kondracki & Clarke

[57] ABSTRACT

An apparatus for feeding flatwork articles to a laundry processing unit, comprising a conveyor belt, at the front end of which flatwork articles can be transferred from a spreading arrangement comprising a pair of carriages running transversely to the longitudinal direction of the conveyor belt, each carriage being provided with a releasable clamp, into which a corner of a flatwork article is inserted, the pair of carriages provided with drives to move the carriages away from each other from a point opposite to the middle of the front end of the conveyor belt to an extended position, in which the upper edge of the flatwork article is spread out, transfer apparatus for the flatwork article to the front end of the conveyor belt, including a pair of rollers, one of which is movable from a retracted position under the upper roller of the conveyor belt and from an advanced position preferably in contact with the spread flatwork article at a short distance from its spread leading edge, and in which the other roller is movable between two positions in such a way that the belt is tight in the two positions taken up by the first roller, and a suction box thereunder.

8 Claims, 2 Drawing Sheets

APPARATUS FOR FEEDING FLATWORK ARTICLES TO A LAUNDRY PROCESSING UNIT

Related subject matter is disclosed and claimed in application Ser. No. 08/012,150, filed Jan. 27, 1993.

FIELD OF THE INVENTION

An apparatus for feeding flatwork articles to a laundry processing unit, for example an ironing roller, said apparatus comprising a conveyor belt, at the front end of which flatwork articles can be transferred from a spreading arrangement comprising a rail means with a pair of carriages running transversely to the longitudinal direction of the conveyor belt, each carriage being provided with a releasable clamp, into which a corner of a flatwork article can be inserted by means of a number of operator-activated insertion devices placed on the side of the rail means opposite to the conveyor belt, said pair of carriages being provided with drive means adapted to move the carriages in the pair of carriages away from each other from a point preferably opposite to the middle of the front end of the conveyor belt to an extended position, in which the clamps are positioned symmetrically with respect to the middle of the conveyor belt, and in which the upper edge of the flatwork article is spread out, means being provided for transferring the upper end of the flatwork article to the front end of the conveyor belt.

DESCRIPTION OF THE RELATED ART

An apparatus of this kind is known from a U.S. Patent assigned to McGraw Edison. In this apparatus the flatwork article is transferred from the operator-activated insertion devices to the releasable clamps in the pair of carriages, whereafter the two carriages are moved apart to spread the leading edge of the flatwork article. The rail means is displaceable in the direction of the conveyor belt, and this displacement is used for taking the leading edge of the flatwork articles over the front end of the conveyor belt. The known apparatus functions in many ways satisfactorily, but suffers from a comparatively limited capacity. Thus, the apparatus is not able to feed flatwork articles in time and at the same speed, as the one at which they can be taken off by a modern ironing roller. The most important factor in limiting the capacity is the transfer of the flatwork article from the clamps in the pair of carriages to the conveyour belt, as it is a prerequisite that the displacement of the rail means is to take place at a speed exceeding that of the conveyor belt. The big mass of the rail means and the accompanying equipment impart to the speed of the conveyor belt used in recent time unjustifiably big accelerating forces.

SUMMARY OF THE INVENTION

The object of the present invention is to modify the known apparatus in such a way that the need for the displaceable rail means is eliminated, the speed of the conveyor belt and subsequently the capacity of the aparatus being increased.

This object is met thereby that the apparatus according to the invention is characteristic by the subject matter of the characterizing clause of claim 1.

According to the invention the flatwork article is not conveyed with the leading edge over the front end of the conveyor belt, but the path of the conveyor belt is changed in such a way that a foremost part of it gets in contact with the flatwork article, the vacuum in the suction box being opened in the part of the conveyor belt which is closest to the leading edge of the flatwork article. The leading edge of the flatwork article will therefore come to rest on the conveyor belt as soon as it is released by the clamps, and will adhere sufficiently for being conveyed on it. The process described takes place momentarily and without the use of bigger movable masses, whereby time is gained so that the pair of carriages will be more quickly ready for receiving the next flatwork article.

The preferred embodiment of the movable front end is disclosed in claim 2. The rocking arrangement makes a most simple design of the foremost movable wall of the suction box possible.

In order to reduce the necessary vaccum in the suction box and to simultaneously ensure a safe transfer of the leading edge of the flatwork article to the conveyor belt, a screen may be placed over the front end of the conveyor belt, said screen creating when the first roller is conveyed, a considerable air flow in the area of the leading edge of the flatwork article.

According to a particularly advantageous embodiment of the apparatus according to the invention the rail means and the means for transferring the flatwork article to the conveyor belt are placed up high in relation to the operators and in that the insertion devices comprise obliquely upwards extending feed elevator means lifting the flatwork article from the operation place of the operator to the pair of clamps. The oblique path of the elevator means contributes to smoothing the flatwork article and give the operators a convenient operating position, a high supply rate to the apparatus being thereby achieved so that the capacity of the apparatus can be exploited. To support the high capacity the three elevator means in the insertion devices are according to the preferred embodiment placed parallel, so that they feed the flatwork articles towards the pair of carriages, which is displaced in relation to the centre of the apparatus. This arrangement prevents the insertion devices from getting in each others way when feeding the clamps in the pair of carriages, which contributes to the attainment of a high capacity, even though it makes the controlling of the movement of the carriages more complicated.

The invention will be described in detail in the following with reference to the accompanying drawing, in which:

DESCRIPTION OF THE PREFERRED EMBODIMENTS

Figure 1:
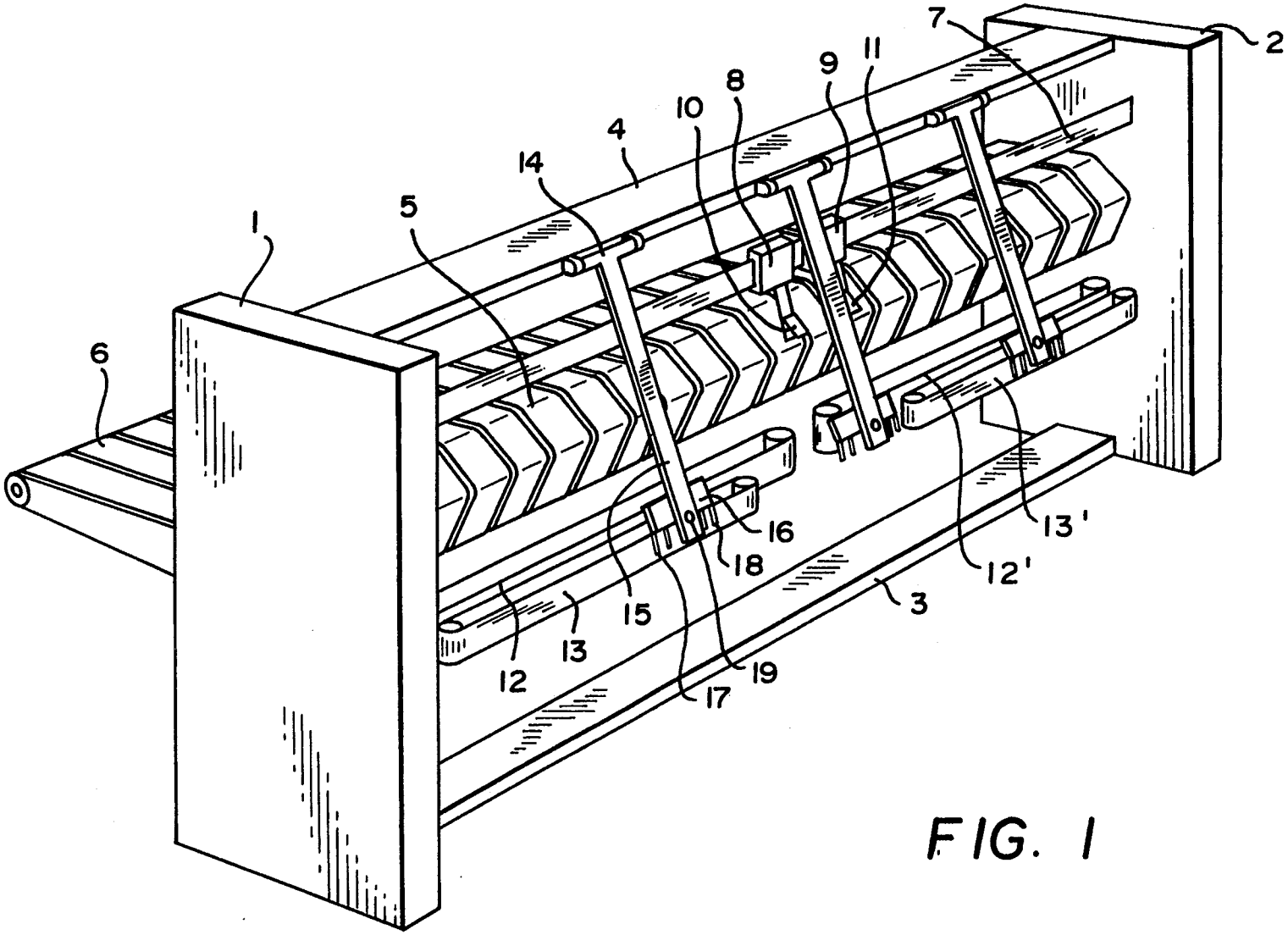
FIG. 1 is an oblique view of an apparatus according to the invention in a simplified form.

The apparatus shown in FIG. 1 for feeding flatwork articles to a laundry processing apparatus, for instance an ironing roller, comprises a frame building a kind of portal with two gables 1 and 2 connected by means of transverse members 3 and 4. The frame thus forms an opening giving room for a conveyor belt 5 conveying flatwork articles, which are spread out and introduced at the front side of the apparatus towards the processing apparatus, which receives the spread out flatwork articles at the end 6 of the conveyor belt. For spreading the flatwork article the apparatus comprises a spreading arrangement, the major components of which are a rail means 7, extending between the two gables 1,2, and two carriages 8 and 9 running thereon. Each of the carriages is provided with a releasable clamp 10 and 11, adapted to hold a corner of a flatwork article, which is to be spread, and, when the carriages have moved apart, to spread out the leading edge of the flatwork article for releasing the flatwork article, which then, by means of the means described below is transferred to the conveyor belt 5. What is transferred to the conveyor belt is the leading edge of the flatwork article, while the rest of the flatwork article is hanging down freely, until by and by it is pulled up on the conveyor belt and conveyed towards the end in flat, spread out condition. To smooth folds, if any, in the down-hanging flatwork articles simultaneously with the carriages being taken apart, it is with the side edges introduced between two pairs of spreading ribbons 12,13 and 12',13'. The pairs of spreading ribbons are driven in the opposite direction in such a way that the ribbon sections facing one another run in the same direction and away from the centre of the apparatus.

It is an important detail in the apparatus that the rail means 7 is placed up high, thereby making it possible for the flatwork article to hang down freely during the spreading operation, which partly enhances the effect of the spreading ribbons 12,13, partly makes it possible to let the conveyor belt consist of two parts, a lower part (not shown), which goes all the way through to the delivery end and has a front end, on which flatwork articles may be placed directly manually, which is often advantageous in case of smaller flatwork articles, the biggest dimension of which does not exceed what can be reached by an operator, while flatwork articles, which are spread by means of the carriages 8,9 are delivered to an upper conveyor belt, which is shorter and the end of which is placed above the lower, through-going conveyor belt. The high positioning of the rail means and the clamps 10,11 prevents operators from directly placing the flatwork article in the clamps 10,11, which would also limit the capacity of the apparatus to what a single operator could perform, and the apparatus is therefore equipped with a number of insertion devices 14. The number will normally be three, but two or four of these devices may also be used. The insertion devices comprise an obliquely upwards extending elevator means 15, on the under side of which a sledge 17 with a downwards facing pair of clamps 17,18 is placed. The operator places a flatwork article in this pair of clamps with one corner in each and then gives a ready-signal on a suitably conveniently placed release button 19. The ready-signal releases an insertion function, controlled by a PLC. Before the flatwork article placed in the clamps can be transferred to the clamps 10,11, the carriages are to be brought into position opposite the insertion device 14 in question. The drive means for the carriages 8,9 therefore comprises means, which are partly able to move the carriages from a random starting position so that they meet opposite one of the three insertion stations 14, where a ready-signal has been given, partly are able to move the carriages together towards the middle of the rail means 7, and partly finally are able to move the carriages symmetrically apart opposite the middle of the rail means. When the carriages are positioned in front of an insertion station, the sledge is moved upwards and the corners of the flatwork articles are caught, the pair of clamps 17,18 passing the clamps 10,11. The sledge is immediately taken back, and the carriages 8,9 are moved to the middle and then symmetrically apart.

The drive means of the carriages may consist of two separate drive engines, which are each via a wire loop driving one of the two carriages. The motors are equipped with a decoder giving signals to the PLC about the positioning of the carriages. The two motors are besides placed with their shafts end to end and with a releasable coupling between the two shafts. By activation of the coupling the two carriages can be moved symmetrically from the position, the carriages had before the activation of the coupling. The arrangement also makes it possible to use powerful eninges, which permit a quick acceleration of the carriages, when this is desired, and a halving of the effect by only supplying one motor with current, when the two shafts are coupled together. The last possibility is most applicable when spreading the edge of the flatwork article, a straining of the edge of the flatwork article being thus avoided.

Figure 2:
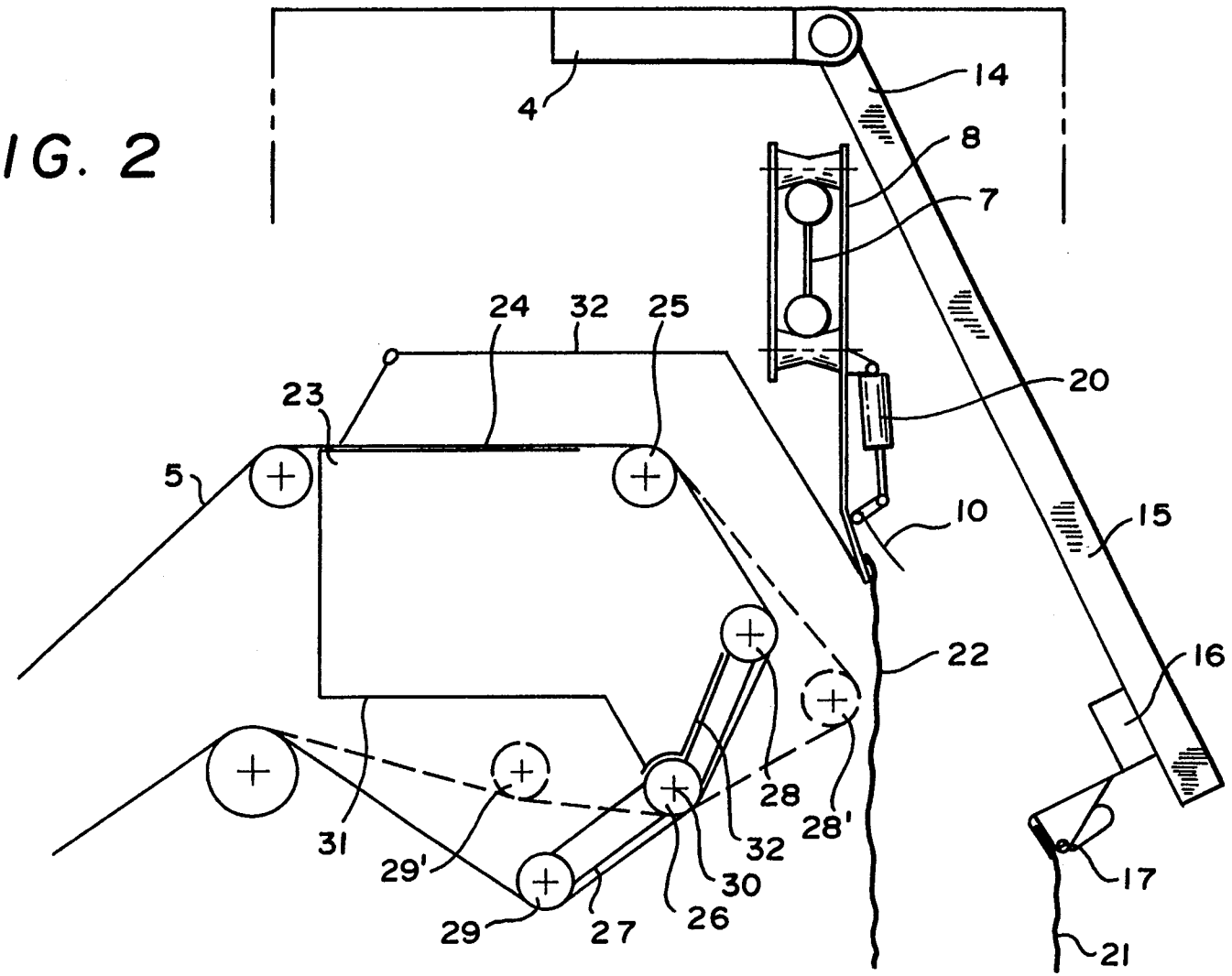
FIG. 2 is a partial longitudinal section through the apparatus illustrating the means used for transfer of the spread flatwork article to the conveyor belt.

FIG. 2 is a sectional view of the arrangement for transferring the flatwork article spread out by means of the carriages 8,9. As the place in front of the real means is taken up by the insertion devices 14, there is no possibility of introducing a bar or another instrument from the front side under the clamps 10,11, thereby brushing the leading edge of the flatwork article on to the conveyor belt 5. With a view to the fact that the next spreading operation is to be started before the trailing edge of the preceding flatwork article has pased the front end of the conveyor belt, the front end of the conveyor belt should be positioned somewhat behind the path of the clamps 10,11 during the spreading operation. These requirements are met by the arrangement shown in a sectional view in FIG. 2. The figure shows the rail means 7 and a carriage 8 running thereon. A clamp 10 is mounted on the carriage 8, said clamp being activated by means of a pneumatic cylinder 20. In front of the rail means and the carriage one of the insertion devices 14 having a slide 16 and a clamp 17 can be seen. In the clamp 17 a flatwork article 22 is inserted, which by upwards displacement of the slide along the rail means 15 of the insertion device is moved upwards and caught by the clamp 10, which is simultaneously activated by means of the cylinder 20. The slide is moved so much past the clamp 10 that the flatwork article 21 is pulled out of the clamp 17, and after the closing of the clamp 10, sufficient room is also given for the slide to move back past the clamp 10. The flatwork article will then be transferred to the position shown by 22. This position is, as will be seen from the figure, in front of and a short distance from the conveyor belt 5 The arrangement will be described in detail in the following.

The conveyor belt 5 is carried by a number of rollers thus enclosing a room, in which a suction box 23 is placed. The suction box has an upper, essentially horizontal wall 24, at the front edge of which a foremost, upper roller 25 is provided. Below the roller 25 is placed a rocking arrangement 26 comprising a two-armed lever 27, at the end of which rollers 28,29 are placed. The lever 26 is journalled around a rocking axis 30. The suction box has a rear wall and a bottom wall 31 extending to and being in close relationship with the rocking arrangement 26 at the axis 30. Between the wall 31 and the roller 28 a screen 32 is placed. The suction box is thus essentially air-tight except for the area between the upper, foremost roller 25 and the roller 28.

The conveyor belt 5 consists either of a perforated lane or a row of comparatively narrow straps placed next to each other. A flatwork article placed on the belt section between the rollers 25 and 28 will therefore be firmly sucked against the belt section, and the friction attained thereby will be sufficient to prevent the flatwork article from sliding, even though the major part of its length hangs freely down from the roller 28. As the roller 28 is positioned somewhat behind the clamps 10, a flatwork article, which is sucked to the belt section between the rollers 25 and 28, will be conveyed on the conveyor belt 5 and transported towards the end 6 (FIG. 1) of the conveyor belt simultaneously with the perpendicular movement on the plane of the figure of the carriage 8 and the clamp 10 in front of the roller 28.

When transferring a flatwork article from the clamps 10 and 11 to the conveyor belt 5, the rocking arrangement is moved from the fully lined position to the postion shown with dotted lines, in which the foremost roller is positioned at 28' and gets in contact with a flatwork article suspended in the clamp 20. Simultaneously with the forward movement of the roller 28, the suction box is opened more, the air flow in the area between the screen and the roller 28' increasing, which expedites the transfer of the leading edge of the flatwork article on the conveyor belt. As soon as the flatwork article gets in contact with the conveyor belt it is sucked thereto and conveyed on the conveyor belt 5. The conveyor belt moves upwards thereby making its grip of the flatwork article more firm, said grip being at its maximum, as soon as the leading edge has reached the roller 25, at which time the rocking arrangement 26 can move back to the fully lined position.

It is possible to reduce the requirements to the vacuum, which must exist in the suction box 23, by covering the front part of the conveyor belt by a screen 32. The screen has at its back a flap allowing passage of the flatwork article on the conveyor belt, and is at the front extending to the bottom part of the clamp 10. The screen 32 serves a double purpose, viz. firstly to concentrate the air flow to the area around the leading edge of the flatwork article, when it is extended between the clamp 10 and the clamp 11 on the second carriage 9, and secondly to form a ruler keeping the leading edge of the flatwork article straight during the spreading. The screen contributes to making the transfer of the flatwork article quick and to attaining an essentially straight leading edge of the flatwork article, when conveyed on the conveyor belt. This is important for the further treatment of the flatwork article in the subsequent processing step, for instance in an ironing roller or a folding machine.

By using a rocking arrangement with two rollers 28 and 29, it will be possible to maintain an essentially constant tightening of the belt by simple means. The constant tightening of the belt may, however, also be obtained in another way, for instance by means of a spring-loaded roller, and correspondingly the movement of the roller 29 may take place in another way than by swinging. The swinging movement is in particular advantageous, while the covering of the suction box may be effected by simple means.

I claim:

1. An apparatus for feeding flatwork articles to an ironing roller, said apparatus comprising a conveyor belt having a front, middle and rear end, at the front end of the conveyor belt flatwork articles are transferred from a spreading arrangement comprising a rail means with a pair of carriages running transversely to the longitudinal direction of the conveyor belt, each carriage being provided with a releasable clamp, into which a corner of a flatwork article is inserted by insertion devices placed on the side of the rail means opposite to the conveyor belt, said pair of carriages provided with drive means to move the carriages away from each other from the middle of the conveyor belt to an extended outward position, in which the clamps are positioned symmetrically with respect to the middle of the conveyor belt, and in which the flatwork article is spread out, means provided for transferring the upper end of the flatwork article to the front end of the conveyor belt, wherein the rail means is fixed in relation to the front end of the conveyor belt, the clamps are positioned opposite to the front end of the conveyor belt, and the transferring means comprise a device placed at the front end under an upper roller of the conveyor belt, said last named device being movable between two positions and comprising two rollers, one of said rollers is movable from a retracted position under the upper roller of the conveyor belt and to an advanced position in contact with the spread flatwork article at a short distance from a spread leading edge thereof, and in which the other roller is movable between two positions in such a way that the conveyor belt is tight in the two positions taken up by the first roller, and a suction box having closed walls at the back and sides, the conveyor belt is perforated to permit the flow of suction therethrough.

2. An apparatus according to claim 1, wherein the first and the second rollers are journalled to a set of double-armed levers, causing a rocking movement around a rocking axis parallel with the rollers.

3. An apparatus according to claim 2, characterized in comprising a screen extending throughout the length of the conveyor belt and over the open part of the suction box at a distance above the conveyor belt, said screen extending towards the leading edge of the spread flatwork article in the position, in which it is fixated by means of the clamps.

4. An apparatus according to claim 2, characterized in that the rail means and the means for transferring the flatwork article to the conveyor belt are placed at a high level in relation to the operators and in that the insertion devices comprise obliquely upwards extending elevator means lifting the flatwork article from the operation place of the operator to the pair of clamps.

5. An apparatus according to claim 1 or 2, wherein a screen extends throughout the length of the conveyor belt and over the suction box at a distance above the conveyor belt, said screen extending towards the leading edge of the spread flatwork article adjacent the clamps.

6. An apparatus according to claim 5, characterized in that the rail means and the means for transferring the flatwork article to the conveyor belt are placed at a high level in relation to the operators and in that the insertion devices comprise obliquely upwards extending elevator means lifting the flatwork article from the operation place of the operator to the pair of clamps.

7. An apparatus according to claims 1, 2 or 5 wherein the rail means and the means for transferring the flatwork article to the conveyor belt include obliquely upwards extending elevator means lifting the flatwork article to the pair of clamps.

8. Apparatus according to claim 7, in which the apparatus comprises three operating stations and the elevator means run parallel and meet the pair of carriages opposite the elevator means, the pair of carriages positioned prior to the spreading movement for the flatwork article.

* * * * *

UNITED STATES PATENT AND TRADEMARK OFFICE

CERTIFICATE OF CORRECTION

PATENT NO. : 5,416,991

DATED : May 23, 1995

INVENTOR(S) : Jorn M. JENSEN

It is certified that error appears in the above-indentified patent and that said Letters Patent is hereby corrected as shown below:

On the title page in column 1 under "[56] References Cited - U.S. PATENT DOCUMENTS" please include the following:

-- 3,421,756 1/1969 Weir ..... 271/79 --

On the title page in column 1 under "[56] References Cited - FOREIGN PATENT DOCUMENTS" please include the following:

| | | | |
|---|---|---|---|
| -- 1332940 | 10/1973 | Great Britain | |
| 2283979 | 9/1975 | France | |
| 1062199 | 3/1989 | Japan | 38/143 |
| 345087 | 12/1989 | EPO -- | |

Signed and Sealed this

Twenty-sixth Day of December, 1995

Bruce Lehman

*Attest:*

BRUCE LEHMAN

*Attesting Officer*

*Commissioner of Patents and Trademarks*